United States Patent [19]

Grosswendt et al.

[11] Patent Number: 4,889,030

[45] Date of Patent: Dec. 26, 1989

[54] PROJECTILE EQUIPPED WITH DEPLOYABLE PARACHUTE

[75] Inventors: Werner Grosswendt, Ratingen; Klaus Unterstein, Duesseldorf, both of Fed. Rep. of Germany

[73] Assignee: Rheinmetall GmbH, Düsseldorf, Fed. Rep. of Germany

[21] Appl. No.: 254,680

[22] PCT Filed: Nov. 5, 1987

[86] PCT No.: PCT/EP87/00674

§ 371 Date: Sep. 22, 1988

§ 102(e) Date: Sep. 22, 1988

[87] PCT Pub. No.: WO88/05523

PCT Pub. Date: Jul. 28, 1988

[30] Foreign Application Priority Data

Jan. 22, 1987 [DE] Fed. Rep. of Germany ..... 3701709

[51] Int. Cl.[4] ..... F42B 13/38

[52] U.S. Cl. ..... 89/1.14; 102/378; 102/387

[58] Field of Search ..... 89/1.14; 102/340, 378, 102/377, 387

[56] References Cited

U.S. PATENT DOCUMENTS

| | | | |
|---|---|---|---|
| 3,071,404 | 1/1963 | Van Hove | 102/378 |
| 3,084,597 | 4/1963 | Beyer | 89/1.14 |
| 3,200,706 | 8/1965 | Kinard | 89/1.14 |
| 3,352,192 | 11/1967 | Carr | 89/1.14 |
| 3,405,593 | 10/1968 | Kriesel | 89/1.14 |
| 3,487,781 | 1/1970 | Oss | 102/377 |
| 3,505,925 | 4/1970 | Carr | 102/378 |
| 3,706,281 | 12/1972 | Hatakeyama | 102/378 |
| 3,902,400 | 9/1975 | Kincheloe et al. | 89/1.14 |
| 3,903,803 | 9/1975 | Losey | 102/378 |
| 3,910,154 | 10/1975 | Gardner | 89/1.14 |
| 4,187,759 | 2/1980 | Toy et al. | 89/1.14 |
| 4,651,648 | 3/1987 | Alon | 102/340 |

FOREIGN PATENT DOCUMENTS

| | | |
|---|---|---|
| 3433434 | 3/1986 | Fed. Rep. of Germany . |
| 1587928 | 4/1970 | France . |
| 2189703 | 1/1974 | France . |
| 2003588 | 3/1979 | United Kingdom . |

*Primary Examiner*—David H. Brown
*Attorney, Agent, or Firm*—Spencer & Frank

[57] ABSTRACT

A projectile has at two parts (3, 4) axially arranged one behind the other and mutually linked, of which at least one contains a deployable parachute (6, 6'). In order to achieve a design that ensures a smooth and reliable separation of the parts (3, 4), followed by the deployment of the parachute (6, 6'), both parts (3, 4) are mutually linked by radial bolts (19) that can be radially actuated by the gas pressure generated by at least one pyrotechnic load (15) and radially moved by the gas pressure, thus separating the two parts (3, 4). The pyrotechnic load (15) can be ignited by a fuse (9).

18 Claims, 5 Drawing Sheets

PROJECTILE EQUIPPED WITH DEPLOYABLE PARACHUTE

BACKGROUND OF THE INVENTION

The invention relates to a projectile equipped with a deployable parachute. More particularly, the present invention relates to such a projectile which is composed of at least two sections arranged axially in tandem and connected with one another by means of radially extending bolts, and with one of the sections accommodating the parachute.

One possibility of recovering projectiles undamaged after firing is to decelerate the flying velocity of the projectile or of its components to acceptable ground impact values with the aid of a parachute. A parachute can also be employed to cause the projectile tip to penetrate into the ground.

To cause the parachute to become effective, it must be ejected on the trajectory or the projectile must be separated in such a way that the parachute is able to automatically deploy as a result of the streaming air.

SUMMARY OF THE INVENTION

It is an object of the invention to provide a projectile having a deployable parachute, with such a projectile being of the type mentioned above with two axially tandem sections connected by radial bolts and having a simple structure and permitting reliable separation for deployment of the parachute.

This object is accomplished according to the invention by a projectile of the above described type wherein the radial bolts are radially chargeable by the gas pressure so as to separate the two sections, with the pyrotechnic charge being burnt off or ignited by way of a fuse.

Further features of the invention are to be found in the description below and in the dependent claims.

The invention will be described below in greater detail with reference to embodiments that are illustrated in the attached drawing figures.

DETAILED DESCRIPTION OF THE PREFERRED EMBODIMENTS

Figure 1:
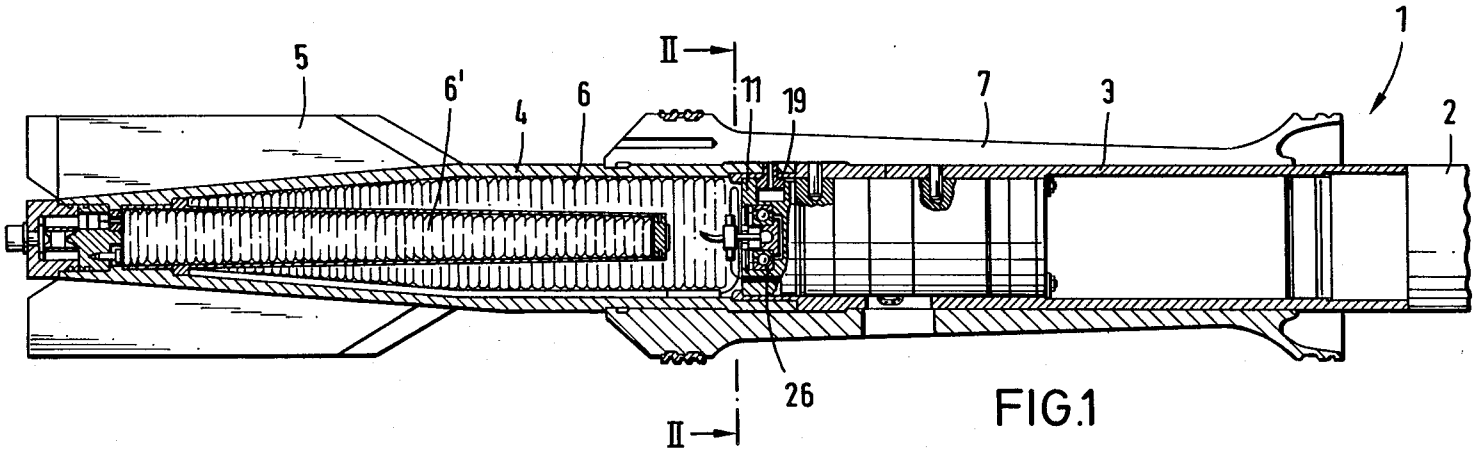
FIG. 1 is a longitudinal sectional view of a projectile equipped with one embodiment of a separating device.
Figure 3:
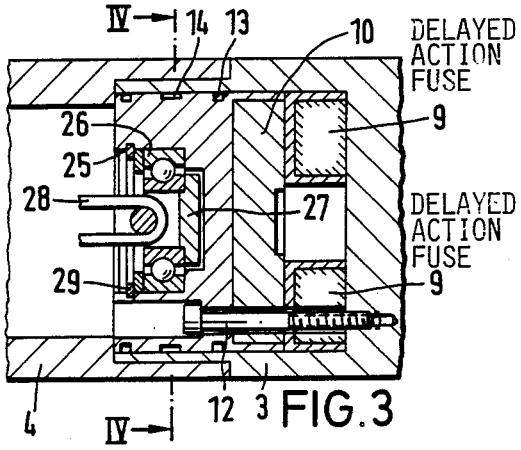
FIG. 3 is a longitudinal sectional view along line III—III of FIG. 2.
Figure 2:
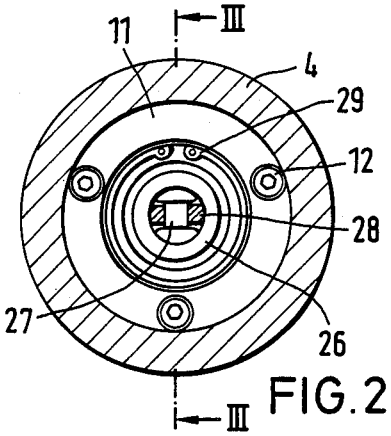
FIG. 2 is a cross-sectional view of the separating device along line II—II of FIG. 1.
Figure 5:
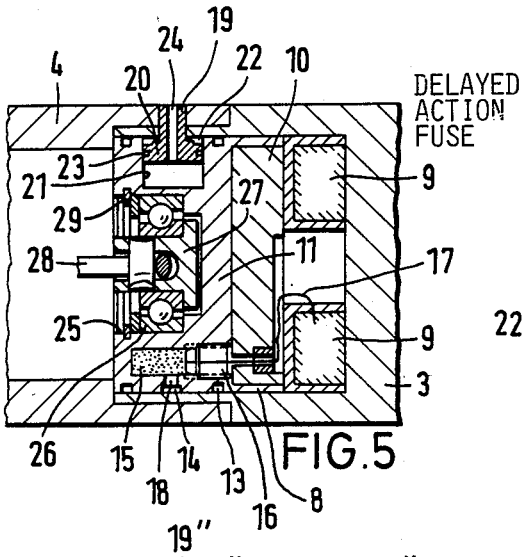
FIG. 5 is a longitudinal sectional view along line V—V of FIG. 4.
Figure 4:
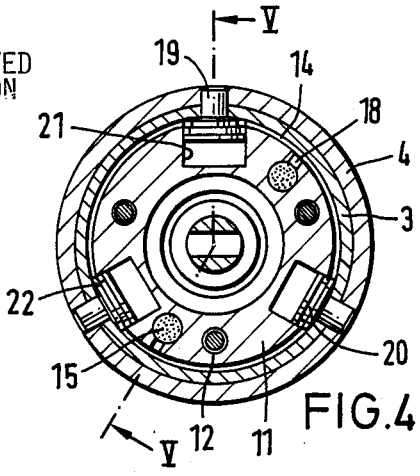
FIG. 4 is a cross-sectional view along line IV—IV of FIG. 3.

In the embodiment shown in FIGS. 1 to 5, a projectile 1 is composed of a nose section 2, a center section 3 and a tail section 4, with tail section 4 being equipped with fins 5 and accommodating two parachutes 6, 6'. Also provided is a propelling cage 7 which extends essentially over the center section 3 and part of the tail section 4 and is discarded upon firing after it has left the gun barrel.

Center section 3 is provided at its rear with a coaxial cylindrical recess 8 at whose bottom two delayed-action fuses 9 are disposed which are covered by means of a plate 10. Recess 8 is closed by an insert 11 which simultaneously accommodates plate 10 and is connected with center section 3 by means of screws 12 extending in the axial direction. On its circumference, insert 11 is sealed against center section 3 by circumferential seals 13 between which there is disposed an annular, circumferential channel 14.

In corresponding blind bores in insert 11, a pyrotechnic charge 15 and a flame capsule 16 are inserted from the side facing plate 10 in two diametrally oppositely disposed positions, the flame capsule 16 being connected by way of conduits 17 extending through plate 10 with the associated delayed-action fuses 9 so that flame capsules 16 can be ignited by delayed-action fuses 9. Gas conducting channels 18 extend from the region of the blind bores accommodating the pyrotechnic charge 15 to the annular channel 14.

Moreover, three bolts 19 are provided which are equipped with pistons 20 at their rear sides and are received in radial bores 21 in insert 11 which are distributed equidistantly over the circumference of insert 11 in the region between the two seals 13. In the region of insert 11, the outer diameter of center section 3 is reduced while tail section 4 has a correspondingly enlarged inner diameter to be able to receive the end of center section 3. In the telescoped state of center section 3 and tail section 4, both sections are provided with bores which are coaxial in the overlapping region and through which bolts 19 extend up to the outer circumference of tail section 4 so as to connect center section 3 and tail section 4 with one another, while a gas pressure chamber 22 exists between the interior of center section 3 and the oppositely disposed side of piston 20, which is disposed in the region of channel 14.

Piston 20 may be provided with a circumferential seal 23 while bolt 19 may be provided with an axial bore 24 which permits easy positioning of bolts 19 during assembly.

Additionally, insert 11 is provided with a recess 25 to accommodate a bearing 26 whose inner ring is connected with an eye 27 which is thus movable and receives a loop 28 of parachute 6. Bearing 26 is secured in insert 11 by a spring ring 29.

If, after firing of projectile 1, parachute 6 is to be deployed, flame capsules 16 are ignited by delayed-action fuses 9 thus causing the pyrotechnic charges 15 to burn off. The gases developed thereby travel through gas conducting channels 18 into annular channel 14 and thus charge the pistons 20 of bolts 19 from the circumferential side by way of gas pressure chamber 22. This causes pistons 20 and thus bolts 19 to be pressed radially inwardly so that they go out of engagement with respect to tail section 4 and the latter is separated from center section 3. Thus parachute 6 which is fastened to center section 3 is released by way of insert 11 and is able to be deployed. Tail section 4 is decelerated by the second parachute 6' whose deployment is also effected by the separation.

In the embodiment shown in FIGS. 6 to 11, center section 3' and tail section 4' are connected with one another by means of clamps 30. Clamps 30 are screwed to bolts 19' which, in turn, are held in insert 11' by axial shear pins 31. Gas conducting channels 18' open into gas pressure chamber 22' between the bottom of bore 21' and the interior of bolt 19' so that the gases generated by the pyrotechnic charges 15 charge bolts 19' from the inside and press them outwardly thus causing shear pins 31 to be sheared off and clamps 30 to be thrown off so that center section 3' and tail section 4' are separated.

Adjacent gas pressure chamber 22', bolts 19' may be provided with a circumferential seal 23'. Delayed-action fuses 9 may be held by means of pins 32 between insert 11' and center section 3'.

In principle bolts 19' which, according to the second embodiment, are secured by shear pins and can be pressed outwardly, can also be used in the first embodiment.

Figure 12:
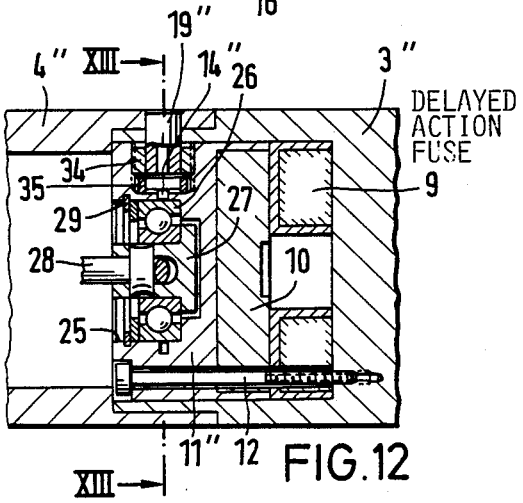
FIG. 12 is a longitudinal sectional view of an additional embodiment of a separating device.
Figure 13:
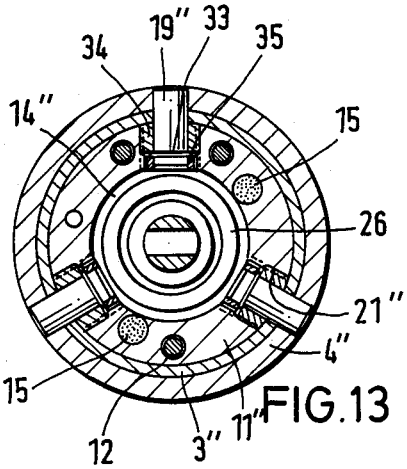
FIG. 13 is a sectional view along line XIII—XIII of FIG. 12.
Figure 6:
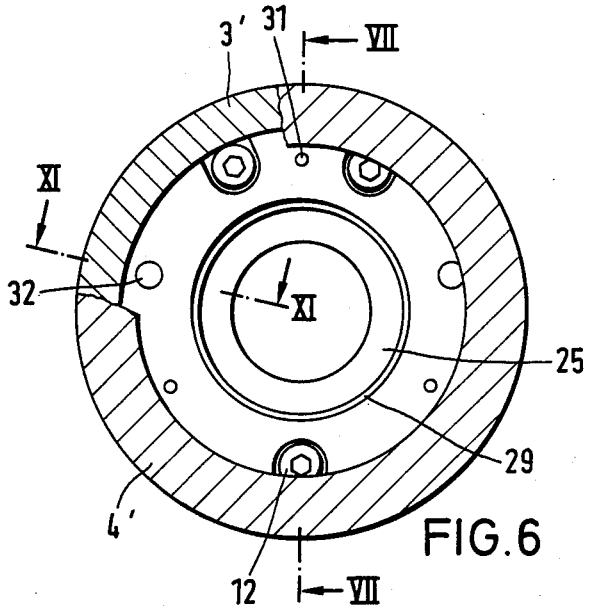
FIG. 6 is a partial cross-sectional rear view of a further embodiment of a separating device.
Figure 7:
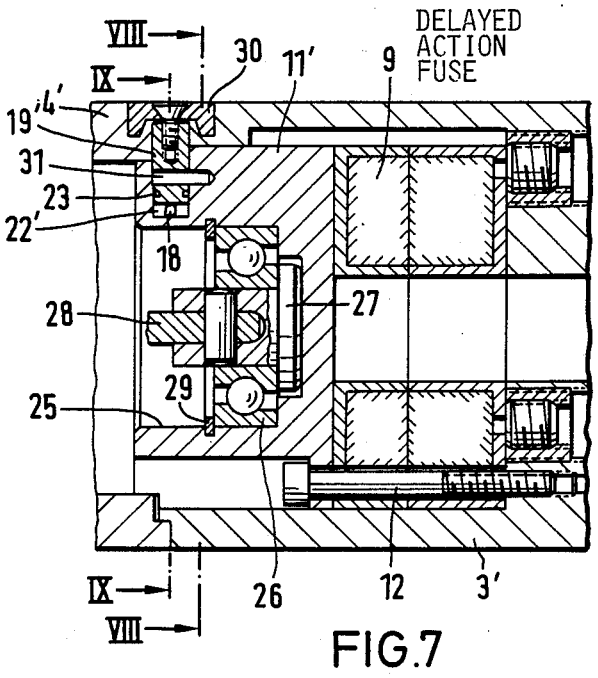
FIG. 7 is a longitudinal sectional view along line VII—VII of FIG. 6.
Figure 8:
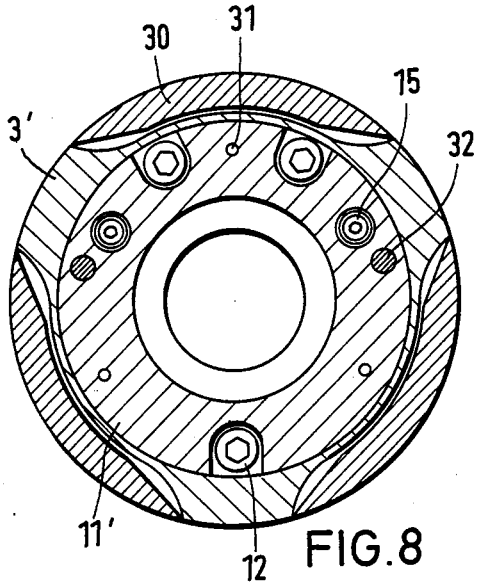
FIGS. 8 to 11 are sectional views corresponding to lines VIII—VIII to XI—XI of FIGS. 6, 7, 8 and 9.
Figure 10:
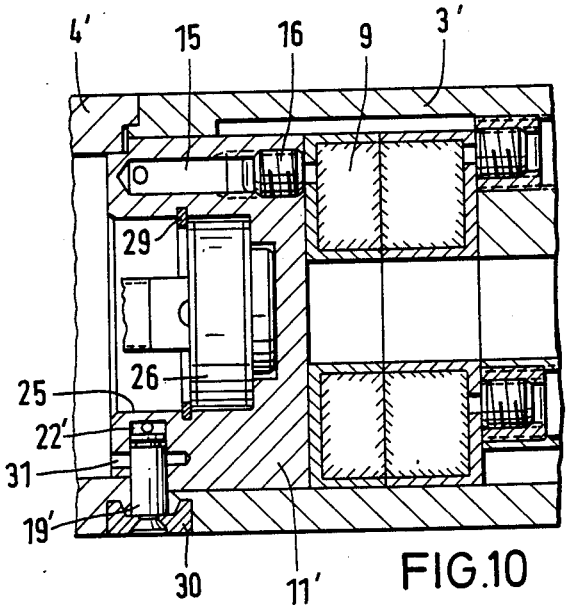
Figure 9:
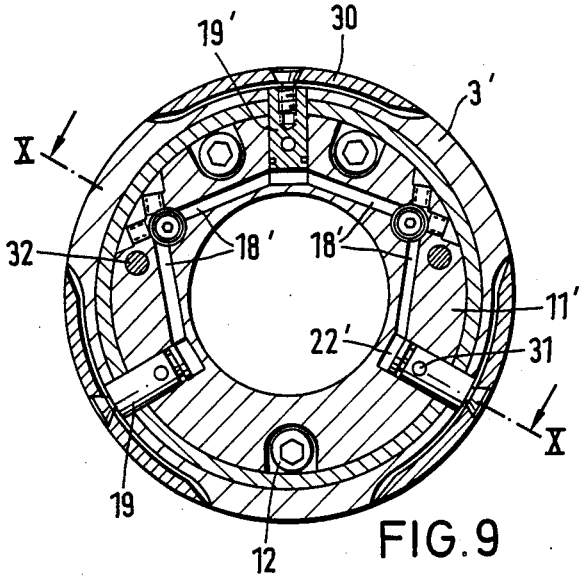
Figure 11:
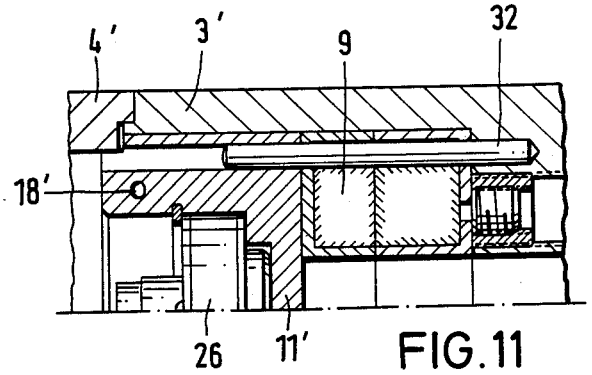

In the embodiment shown in FIGS. 12 and 13, shear pins 31 are replaced by shear discs 33 which are held by a two-part bolt 19''. Bores 21'' are designed as threaded bores and receive a threaded ring 34 which supports shear disc 33 toward the exterior and surrounds bolt 19''. Between shear disc 33 and the bottom of bore 21'', a ring 35 is inserted which surrounds bolt 19'' so that the gases released by pyrotechnic charges 15 act only on the interior frontal faces of bolts 19''.

An annular channel 14'' is here provided at the interior of recess 15'' and is closed toward the outside by bearing 26. Channel 14'' is in communication with bores 21'' and with the bores accommodating pyrotechnic charges 15 so that the inner frontal faces of bolts 19'' are charged directly by the gas pressure from the combustion of pyrotechnic charges 15 through channel 14''.

We claim:

1. In a projectile including at least two sections arranged axially in tandem, a plurality of radial bolts disposed in respective radially extending bores connecting said two sections together, means, disposed in said projectile and including a pyrotechnic charge and a fuse for causing ignition of said charge, for producing a gas pressure for radially displacing said bolts to release the connection between and separate said two sections of said projectile, and at least one deployable parachute accommodated in one of said two sections; the improvement wherein said means for generating a gas pressure for radially displacing said bolts include gas conducting channels leading from said pyrotechnic charge to said radial bores to directly apply said gas pressure to a respective frontal face of each of said plurality of bolts which is to be charged with gas pressure.

2. Projectile according to claim 1 wherein said pyrotechnic charge is ignited by a flame capsule disposed in the projectile adjacent the charge.

3. Projectile according to claim 1, wherein said fuses are delayed-action fuses.

4. A projectile according to claim 1 wherein said bolts are displaceable radially inwardly by the gas pressure and are provided with larger diameter piston portions at their interior ends; and said gas conducting channels open into said bores exteriorly of the respective exterior frontal faces of said piston portions which are charged by the gas pressure from the exterior.

5. Projectile according to claim 1 wherein one of said two sections accommodates an insert which is provided with said radial bores for the bolts and accommodates said pyrotechnic charge and said gas conducting channels which lead from the pyrotechnic charge to the respective frontal faces of the bolts which are to be charged with gas pressure.

6. A projectile as defined in claim 5 wherein: said one section accommodating said parachute is a tail section of said projectile; said insert is fastened to the second of said two connected sections at its rear; and said parachute is connected to said insert.

7. Projectile according to claim 5 wherein said insert is disposed in the second of said two connected sections and is connected with said parachute by an eye.

8. Projectile according to claim 7, wherein said insert accommodates a bearing by which the eye is held rotatable relative to the insert.

9. Projectile according to claim 5 wherein: said bolts are displaceable radially inwardly by the gas pressure and are provided with larger diameter piston portions at their interior ends; and said gas conducting channels open into said bores exteriorly of the respective exterior frontal faces of said piston portions which are charged by the gas pressure from the exterior.

10. Projectile according to claim 9, wherein said gas conducting channels include an annular channel disposed on the exterior circumference of said insert with said annular channel opening into said bores adjacent to the outwardly oriented frontal face of the respective piston portions and being connected with further gas conducting channels which open into the region containing the pyrotechnic charge.

11. Projectile according to claim 9, wherein said bolts are provided with axial passage openings.

12. Projectile according to claim 1 wherein: said bolts can be displaced radially outwardly by the gas pressure; said gas conducting channels open into said bores so that the respective interior frontal faces of said bolts can be charged with gas pressure; and said bolts are secured by shear means.

13. Projectile according to claim 12, wherein said shear means are axial shear pins.

14. Projectile according to claim 12, wherein: said one section is the tail section of said projectile; each bolt is screwed to a clamp which connects the other section with the tail section; and said clamps are releasable from the other section and from the tail section by the radial displacement of the bolt toward the outside.

15. Projectile according to claim 12, wherein said shear means are shear discs.

16. Projectile according to claim 15, wherein said shear discs are held by said bolts which are two-part bolts.

17. Projectile according to claim 15, wherein said bores are configured as threaded bores and each receives a threaded ring which supports the shear disc toward the exterior.

18. Projectile according to claim 15 wherein a ring which surrounds the respective bolt is inserted between the bottom of each bore and the respective shear disc, with the gas conducting channels opening within the ring into the space between the bolts and the bottom of respective bore.

* * * * *